US006808156B2

(12) United States Patent
Bond

(10) Patent No.: US 6,808,156 B2
(45) Date of Patent: Oct. 26, 2004

(54) METHOD AND APPARATUS FOR MOLDING CONCRETE INTO A BRIDGE OR OTHER STRUCTURE

(75) Inventor: Lesley O. Bond, Neosho, MO (US)

(73) Assignee: Bond-Parker Engineering Co., Oklahoma City, OK (US)

( * ) Notice: Subject to any disclaimer, the term of this patent is extended or adjusted under 35 U.S.C. 154(b) by 0 days.

(21) Appl. No.: 10/050,354

(22) Filed: Jan. 16, 2002

(65) Prior Publication Data

US 2004/0075041 A1 Apr. 22, 2004

(51) Int. Cl.[7] ..... E21D 11/10; E04G 11/08
(52) U.S. Cl. ..... 249/209; 249/10; 249/11
(58) Field of Search ..... 405/132, 149, 405/150.1, 150.2, 155, 157, 178; 249/10, 11, 12, 209, 1, 13, 18, 50, 172, 175, 184, 188, 212; 264/31, 32, 333

(56) References Cited

U.S. PATENT DOCUMENTS

| | | | | | |
|---|---|---|---|---|---|
| 1,761,848 | A | * | 6/1930 | Sitzman et al. | 52/125.4 |
| 1,964,386 | A | * | 6/1934 | Nose | 249/11 |
| 3,899,153 | A | * | 8/1975 | Friedl | 249/65 |
| 4,038,798 | A | * | 8/1977 | Sachs | 52/309.7 |
| 4,314,775 | A | | 2/1982 | Johnson | |
| 4,390,306 | A | | 6/1983 | Fisher | |
| 4,746,471 | A | * | 5/1988 | Hale | 249/65 |
| 4,890,993 | A | | 1/1990 | Wilson | |
| 4,930,937 | A | | 6/1990 | Fulton | |
| 5,940,917 | A | | 8/1999 | Wilson et al. | |

FOREIGN PATENT DOCUMENTS

| | | |
|---|---|---|
| DE | 19814538 A1 | 10/1999 |
| WO | WO 82/03644 | 12/1982 |

OTHER PUBLICATIONS

Patent Abstract in English of DE 19814538.
International Search Report mailed Apr. 15, 2004 in International Application No. PCT/US03/26085.

* cited by examiner

*Primary Examiner*—Frederick L. Lagman
(74) *Attorney, Agent, or Firm*—Mary M. Lee

(57) ABSTRACT

A method and mold assembly for forming concrete or another moldable composition. A plurality of elongate elements, such as PVC pipes, are stacked in rows in gravity-stable arrangement to form a contour, such as an arch. The radius of the arch may be controlled by arranging the pipes as desired. Particulate matter, such as sand, may be used between the stacked pipes. Also, an anchor assembly can be used to secure one or more of the pipes to the earth. After the pipes are stacked and a bed of sand has been placed thereon, a waterproof cover is laid over the top of the stack, and layer of concrete is spread. After the concrete is set, the pipes, the cover and the anchor assemblies are removed. The removal will be expedited by washing the sand from the stack. Once removed, the pipes and anchors can be reused indefinitely.

40 Claims, 8 Drawing Sheets

METHOD AND APPARATUS FOR MOLDING CONCRETE INTO A BRIDGE OR OTHER STRUCTURE

FIELD OF THE INVENTION

The present invention relates generally to methods and apparatus for molding concrete and other moldable compositions and, more particularly, to methods and molds for forming concrete into arched supports for bridges and the like.

BACKGROUND OF THE INVENTION

Bridges and overpasses are essential components of any roadway system. The building of bridges is one of the oldest engineering tasks still in practice, and an almost infinite variety of techniques and materials have been employed. The oldest bridge still in use is an oval type that is more than 2,200 years old.

Today, the most common bridge is a column and truss structure, using pre-cast concrete beams as the load bearing mechanism. The useful lifespan of today's bridges is relatively short in spite of the costs. Fifty years, by any standard, is a short useful lifespan of a bridge structure, and many have not achieved even that durability due to the deterioration of the bridge's infrastructure.

The basic purpose of a bridge is to form and hold a roadbed stationary while spanning a natural or man-made water channel or road. Planning the actual shape and dimensions of the bridge takes into account the intended use, existing physical features, and maximum "extreme" anticipated flow in the drainage channel beneath.

These factors can be calculated manually. However, there are numerous computer programs designed to model the anticipated flows and desired shapes in a channel that take into account the variables in a drainage area. For a discussion of variables in flow through a culvert or bridge and guidelines for cross-section areas for channels, see Normann, J. M., 1985 (Hydraulic Design Series 5, NTIS publication PB86196961).

The local variables of water flow are usually known or available. The bridge cavity over the channel must carry all the water flow coming under the structure, up to maximum extreme conditions, unless backwaters above the bridge are acceptable. In some applications, it may be practical to have excess water flow over the roadbed in extreme conditions. One design provides a large arch for normal and anticipated flow and smaller arches on each side for unusual and extreme conditions.

Concrete is commonly used to form beams and piers and other components of today's bridges and overpasses. It is used as a covering material for the steel framework and roadbed. In the "column and truss" type bridge structure, the road surface is designed in a tension configuration. Deterioration of the steel reinforcing material, due to chemical reactions within the load bearing members and improper bonding, is the principal cause for bridges requiring repairs or replacement.

A very large number of bridges in the United States interstate system have failed to be useful for the expected lifespan of the structure. Poor construction practices were followed in some cases. However, the major problem lies in the basic tension design, where the load is vertical or down and the support is acting at 90 degrees or horizontally in tension.

Even with the advancements in bridge building techniques presently available, there remains a need for a technique that will produce an adequate structure at a lower cost. There is a need for a technique that will allow such structures to be produced using simple manual labor and without requiring large cranes or other expensive and dangerous equipment. There continues to be a need to produce structures using concrete, because of its low cost and availability, but which will be long-lasting. Still further, there is a need for a system that will permit structures that can be custom built to accommodate local terrain and that will be aesthetically pleasing.

SUMMARY OF THE INVENTION

The present invention is directed to a mold assembly. The assembly comprises a plurality of elongate elements stacked parallel to each other in multiple rows and in gravity-stable arrangement to form an upper contour of a selected shape.

Still further, the present invention includes a method for molding a moldable composition. The method comprises stacking a plurality of elongate elements parallel to each other in multiple rows and in gravity-stable arrangement to form an upper contour of a selected shape. Unset moldable composition is spread over the upper contour of the stacked elongate elements. The moldable composition is allowed to set up, and the stacked elongate elements are removed.

BRIEF DESCRIPTION OF THE DRAWINGS

FIG. 9 illustrates a connector for connecting pipes end to end to provide extended lengths of pipes.

DETAILED DESCRIPTION OF THE PREFERRED EMBODIMENT

Figure 1:
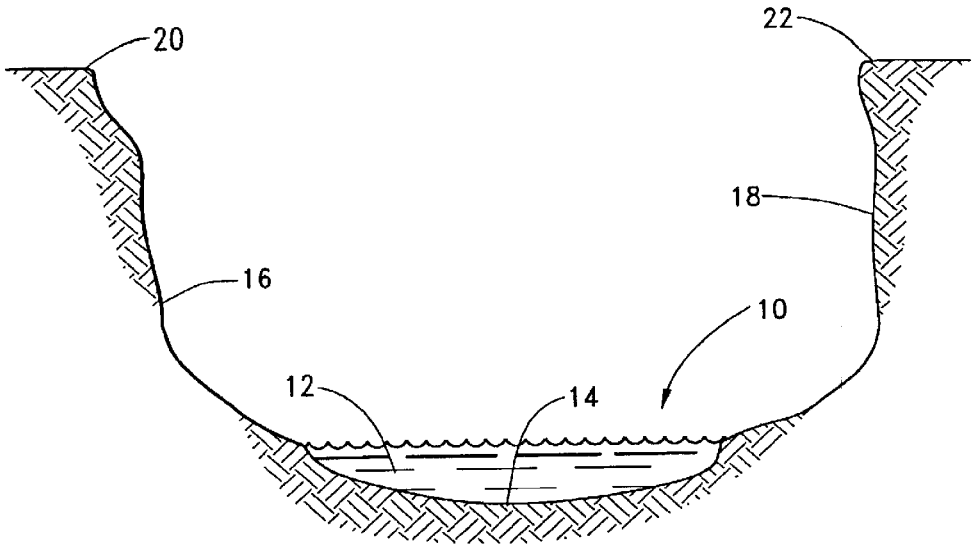
FIG. 1 is a diagrammatic illustration of a waterway, such as a stream, over which a roadway is to be built.

In a preferred embodiment, the method and apparatus of the present invention provide a simple and inexpensive technique for forming a moldable composition, such as concrete, into a bridge support. The construction method of the present invention allows concrete to be formed in an oval shape so that the finished product becomes a curved structure in compression. In this way, durable and inexpensive construction concrete can be used to a maximum engineering advantage.

Still further, the use of the multiple elongate elements to custom form the mold, allows virtually any configuration to be created. It can accommodate nearby trees and uneven terrain, and can produce asymmetrical and irregular shapes. The structure can be designed with visible or exposed surfaces covered with brick, stone, or other decorative materials, to enhance appearance as well as durability.

All the materials and equipment are easy to use and readily available. Excavation for the footings requires only the use of an ordinary backhoe. Indeed, in some cases, the excavations could be dug manually. Because the mold is formed on the site, no cranes or other heavy machines are necessary to move large pre-formed concrete structures. Eliminating the use of heavy machinery to transport and position large pre-formed components substantially reduces the risk of personal injury at the site and damage to the nearby landscape.

The PVC pipes preferably used to form the mold are lightweight and can be arranged manually by one or two workers. Thus, only a few workers can complete the entire assembly and method, so that both labor and materials are relatively inexpensive. Yet, the end product has a high tension and compression strength, and will last longer.

Accordingly, the labor and materials are relatively inexpensive. In addition, the pipes and the anchor assemblies can be collected at the completion of one project and can be reused in future projects indefinitely.

In accordance with the present invention, a mold assembly and method is provided to form a span of concrete or other moldable composition into a selected shape. As used herein, "moldable composition" refers to a composition, which in an initial, liquid or unset condition is plastic and can be spread and molded, and which in a dry or set condition will harden into a sturdy or rigid form.

Concrete is a preferred moldable composition. Concrete is a mixture of cement, sand, gravel and water in a moldable or plastic form when initially mixed. Upon setting and curing, concrete becomes hard and solid material comparable to solid limestone rock. Concrete is inexpensive, readily available, extremely durable, easy to use in this application, and strong when used in compression. Concrete does not decay, rust or deteriorate with age unless exposed to the elements. Construction concrete has a normal compressive strength in the 3,000 to 5,000 psi range when cured for 28 days. State and federal highways frequently use concrete for roads that are in the higher 5,000 psi range.

With reference now to the drawings in general and to FIG. 1 in particular, there is shown therein a stream 10 over which a bridge is to be built. The stream water 12 flows along a streambed 14 between opposing embankments 16 and 18 for supporting connecting portions of the roadbed 20 and 22 at the top of the embankments.

In accordance with this embodiment of the method of the present invention, a streambed 14 has been selected as the site for construction of the mold assembly. However, the present invention is not so limited. This method and apparatus could be utilized to form spans of moldable composition over any sort of structure or geologic formation.

Figure 2:
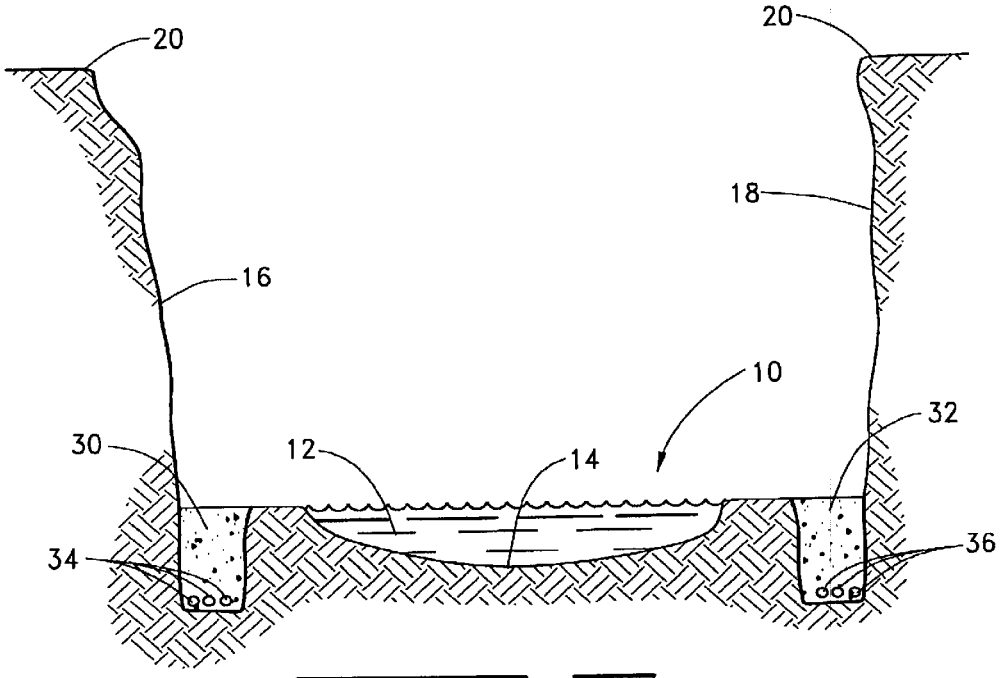
FIG. 2 is a diagrammatic illustration of the excavations on both sides of the stream and the steel-reinforced concrete footings therein to support the concrete span to be molded.

Having selected the location for the concrete span, footings preferably first are formed. As shown in FIG. 2, the footings 30 and 32 typically will be positioned on both sides of the stream 10 above the water level. A backhoe, or other earth moving equipment, may be used to excavate the earth to a depth where solid material is exposed. Then the excavations are filled with a volume of premixed concrete to fill the excavated cavities.

Preferably, rebars 34 and 36 are laid lengthwise (parallel to the stream flow) in the concrete for added strength. Rebars (not shown) may also be placed vertically in the footings 30 and 32 to strengthen the area between the footings and the oval concrete in the mold being assembled.

Figure 3:
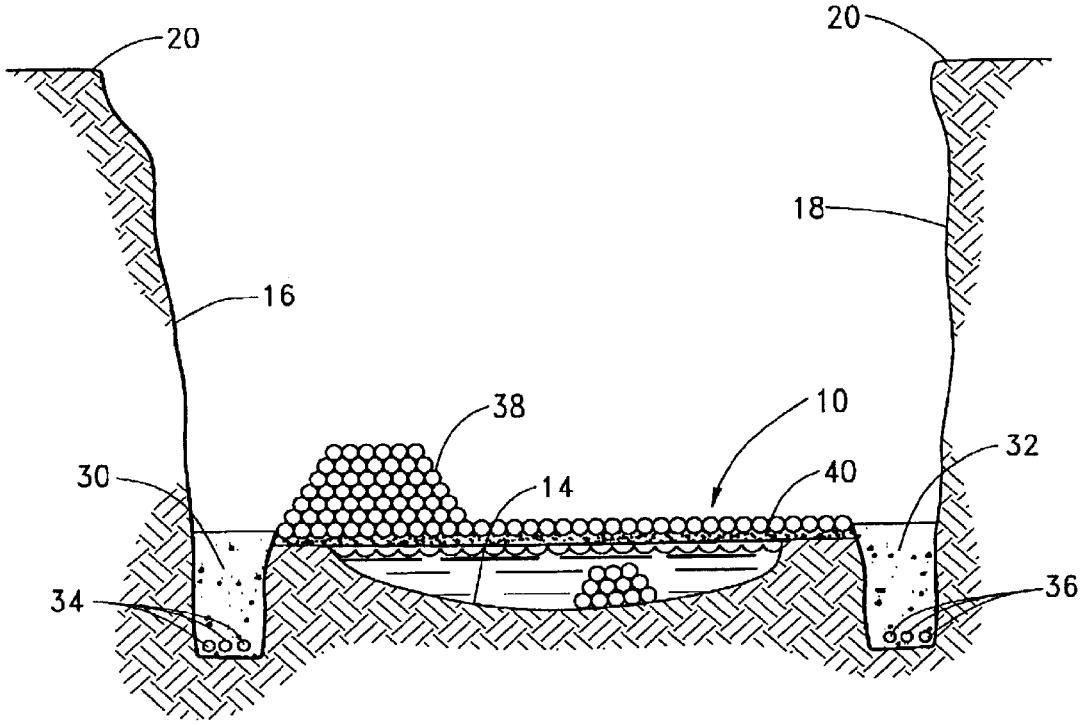
FIG. 3 is illustrates the first steps in building the mold assembly of the present invention.
Figure 4:
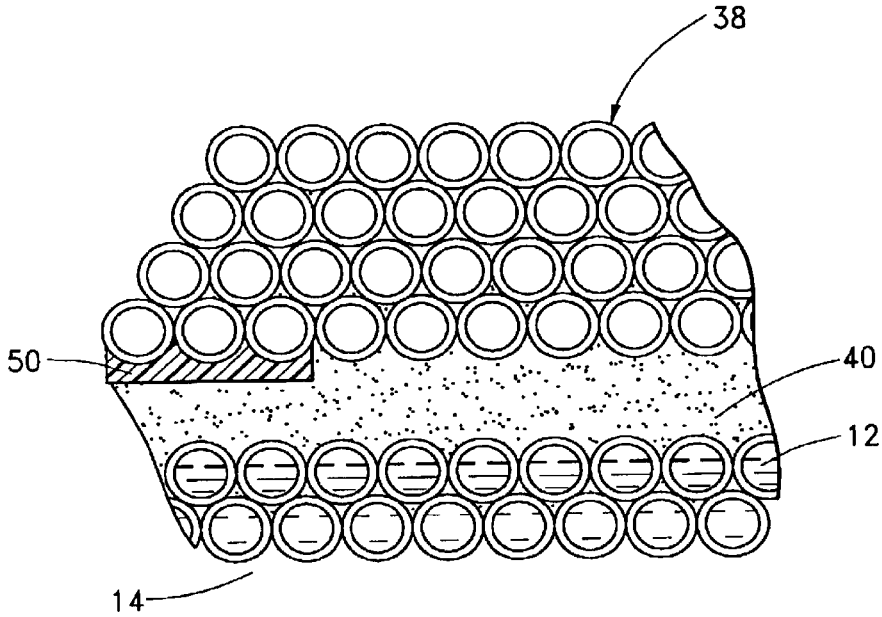
FIG. 4 is an enlarged view of the circled zone in FIG. 4 illustrating the sand used to form a leveling bed under the pipes and as a filler between the pipes.

After the footings 30 and 32 have been poured in place, the construction of the mold assembly commences. Turning now to FIGS. 3 and 4, a plurality of elongate elements is stacked in the streambed 14. Preferably, the elongate elements are hollow or tubular, and round in cross-section. More preferably, the elongate elements are plastic. Even more preferably, the elongate elements are PVC pipe sections, designated individually and collectively by the reference numeral 38, of approximately equal length. PVC pipe is water proof, lightweight, inexpensive and readily available. In this embodiment, tubular elements allow the stream water 12 to continue to flow throughout the construction of the mold assembly and the bridge.

The pipes 38 are stacked in the streambed 14 until the top of the stack of pipes is well above the water in the channel or stream 10. The pipes 38 are stacked lengthwise (parallel to the stream) and parallel to each other in multiple rows and in a gravity-stable arrangement.

Next, a bed of sand 40 preferably is placed over the top of the stacked pipes 38 above the water level to form a sand bed 40 about 4 to 6 inches thick. While sand is used in this embodiment, other suitable particulate matter can be used instead, such as agricultural liming material ("ag-lime"). The particulate matter is used to level and stabilize the pipes, described hereafter. In addition, as explained below, the particulate matter is also used to release the pipes when the process is completed and the particulate matter is washed out of the mold with pressurized water. The particulate matter should be non-toxic and non-polluting to the environment.

Next, more pipes 38 are stacked on the bed of sand 40 above the streambed 14 to form a selected shape. The shape of the designed structure will be determined by the physical topography, channel or flow requirements, or both, as well as the intended uses. While the arch shape is preferred, because of the great strength this design provides per unit cost, other shapes could be selected to fit different conditions. For example, the shape could be an ellipse to achieve a greater span with less height.

In the present embodiment, the selected shape is an arch, as shown and described hereafter. The size and radius of the arch can vary widely. In addition, the selected shape could comprise two or more arches. Alternately, a higher footing could be used to increase the flow capacity in the structure.

The stacked pipes 38 will nest by gravity in the sand bed 40. More pipes 38 are added to the stack until the upper contour assumes the selected shape. While the pipes 38 are being stacked, sand may be poured to occupy the cavities or interstitial spaces between the pipes and add stability to the stack, as best seen in FIG. 4. The sand in between the pipes 38 also adds some friction between the pipes also contributing to the stability of the stack.

In some cases, it is advantageous to provide an anchor assembly 50 under the pipes 38. The anchor assembly 50 preferably is sized to receive and support a plurality of the pipes 38 adjacent to each other in a side-by-side arrangement and to anchor the mold assembly to the underlying earth. The anchor assembly 50 will be described in more detail hereafter.

Although not illustrated in the drawings, conditions may exist which make it advantageous to form a connecting bed of concrete between the footings 30 and 32 (FIG. 3) to form a floor in the channel. To do this, the fill material in the streambed 14 would be excavated to a depth to solid rock or competent material and concrete would be poured on the exposed surface. The finished concrete "floor" would be sloped downstream and serve to prevent or retard erosion of the streambed and footings. After the footings and the floor have been poured and allowed to set for 24 hours, or until a sufficient strength has been achieved, the construction of the mold assembly is continued.

Figures 5, 5A:
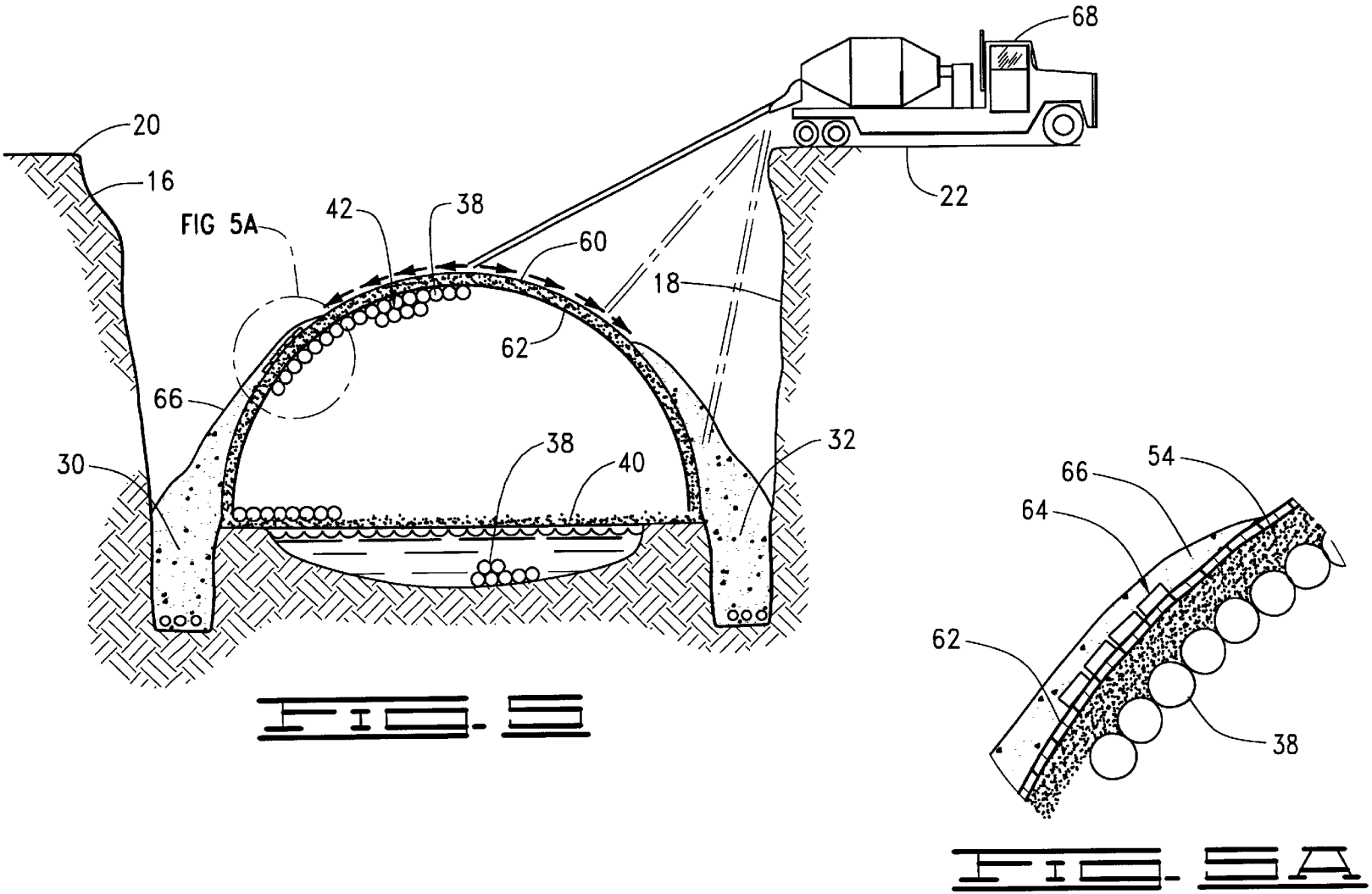
FIG. 5 is a diagrammatic view of how the concrete is poured from a mixing truck positioned on the roadbed adjacent the stream.
Figure 5:
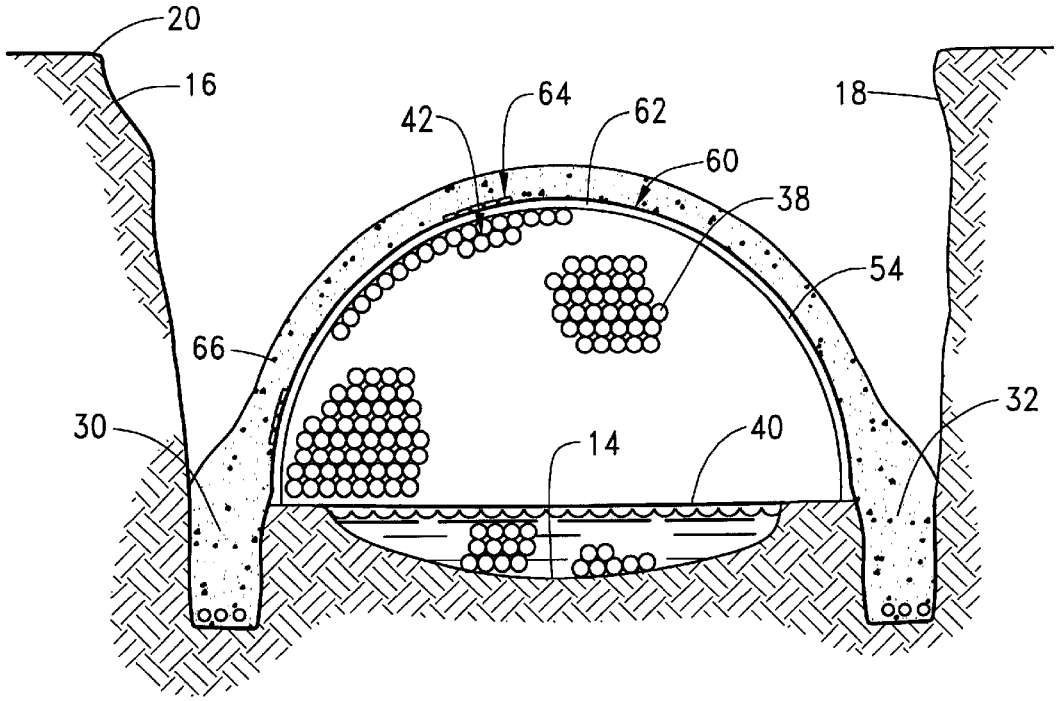

Turning now to FIG. 5, the construction of the mold assembly, now designated generally as 60, is continued. Once, the stack 42 of PVC pipes 38 is completed, a top layer of sand 54 or other particulate matter preferably is placed over the top of the stack of pipes.

Then, in most instances, a flexible cover 62 preferably is spread over the stack. This cover 62 is sized to cover substantially the entire upper surface or contour formed by the stacked pipes 42. In addition, the cover 62 should be characterized as not permanently adherable to the concrete or other moldable composition to be formed over the mold assembly. That is, while the concrete might adhere initially to the cover 62, there is no permanent bonding; the cover can be removed from under the set concrete, as described below. Inexpensive plastic sheeting or a plastic tarp of sufficient size will suffice.

Once the mold assembly 60 is completed, a layer of unset moldable composition is spread over the upper contour of the mold assembly. Preferably, the unset moldable composition will be ready-mix concrete 66.

While a simple, unadorned span of concrete provides adequate support, the present invention contemplates aesthetic features as well. Accordingly, in the preferred embodiment, the arch is provided with a facade or veneer 64 of brick, stone or gravel, for example. This veneer, in addition to enhancing the appearance of the exposed surfaces of the support, will protect the underlying concrete as well.

The addition of a veneer 64 can be accomplished by laying down the veneer material over the cover 62 prior to the pouring the concrete. See FIGS. 5 and 7. A matrix or frame (not shown) may be used to hold the veneer material 64 in place while the concrete 66 is spread and tamped. This forces the concrete between and around the veneer material to fill the voids and act as mortar. The veneer material 64 can be added to the exposed sides of the support by hand or by using frames.

Figure 6:
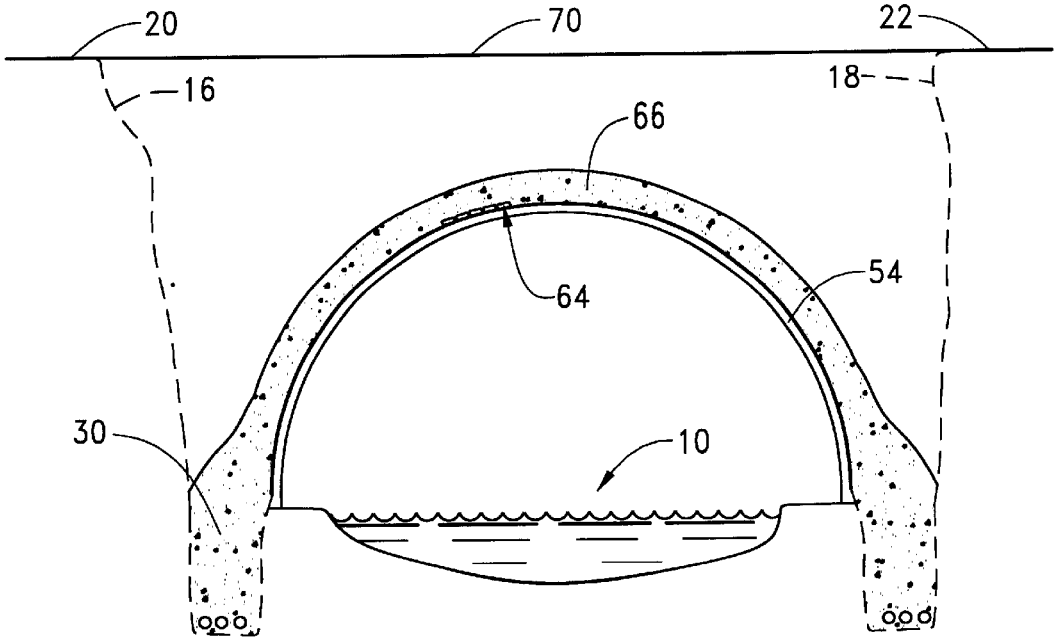
FIG. 6 shows a completed concrete arch formed over the assembled mold.
Figure 7:
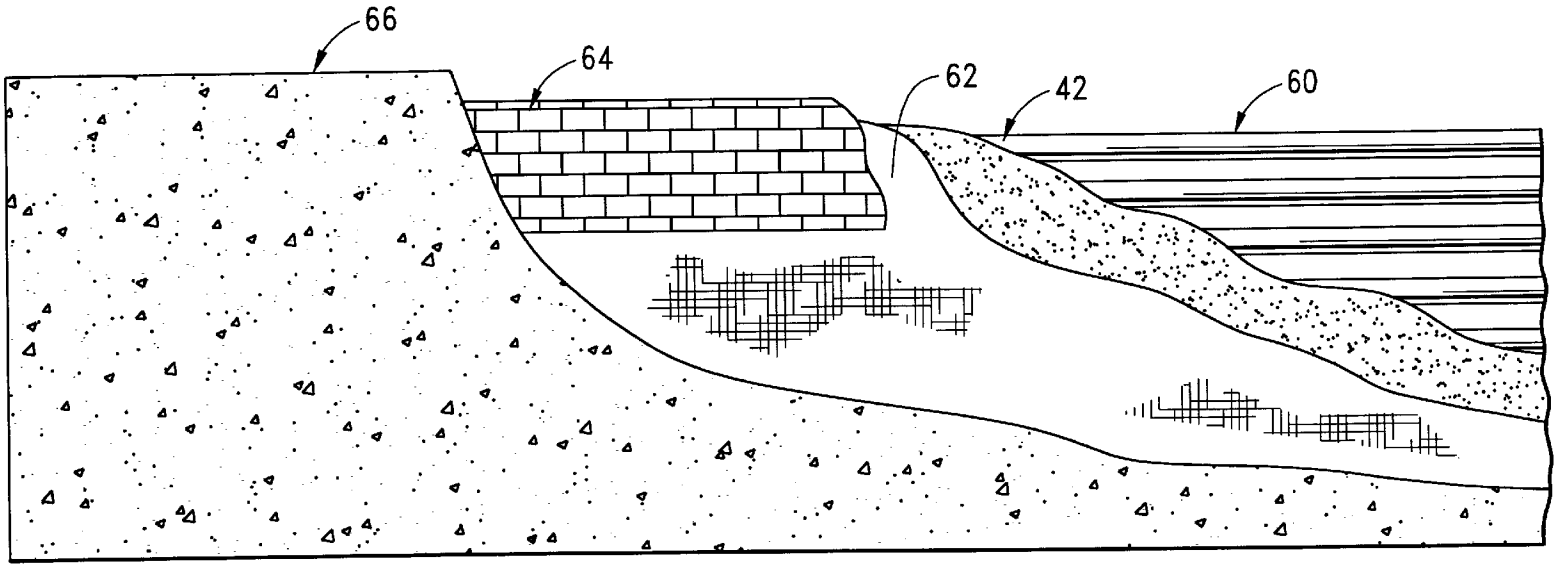
FIG. 7 illustrates the concrete arch over the streambed after the mold has been disassembled and removed and a roadway has been built over the arch. Fill material occupies the space beneath the roadway and above the arch.

Having positioned the desired veneer material 64 in place, concrete 66 is poured from a truck 68 parked nearby, such as on the roadbed 22 above the embankment 18. FIGS. 6 and 7 illustrate the structure of the complete concrete layer 66 over the stacked pipes 42, with the cover 62 and the veneer material 64 therebetween.

Preferably, the concrete layer 66 is spread over the entire mold assembly 60 in a substantially consistent thickness, as seen in FIG. 6. The required thickness of the concrete poured over the mold to form a structure can be calculated, or determined, from strength design programs. These computer programs, such as RISA 3 D, take into account loading, curvature shapes, and all forces acting on the structure, including shock loading and earthquakes.

The layer of concrete 66 should extend between the concrete footings 30 and 32 on either side of the mold assembly 60. As the concrete 66 is being poured into position on the assembly 60, the concrete should be worked or vibrated by mechanical means to remove any entrapped air and to fill any voids in the soft concrete, and to ensure that the concrete fills the voids between the veneer material 64.

Once pouring the concrete has started, the job usually can be finished in one continuous pour. To span a 20-foot channel with a 10-foot high arch, the concrete required would be approximately 100 cubic yards for an arch 18 inches thick and a structure 50 feet long. The concrete layer 66 should be allowed to cure to a strength of 50 percent (usually 72–96 hours) in a humid environment.

Once the concrete layer 66 has achieved a sufficient strength, the mold assembly 60 may be removed. To that end, a spray of water is used to dislodge and remove the sand layers 40 and 54, as well as the sand between the pipes. The non-toxic sand can be retrieved for disposal, or dispersed in the streambed 14, as may be deemed appropriate. Removal of the sand loosens the pipes 38 in the mold assembly 60, and allows the pipes to be removed easily. Where one or more anchor assemblies 50 have been used, these are also removed and collected. Both the pipes and the anchor assemblies may be reused indefinitely on other projects.

After the uppermost pipes 38 are removed, the flexible cover 62 can be pulled off the underside of the concrete layer 66, now an arch. When the mold assembly 60 is disassembled, and the cover 62 is removed from the underside of the arch, any matrix supporting the veneer material 64 can be peeled away. Thus, there is left exposed the decorative and protective surface formed by the veneer 64. (See also FIG. 15)

Figure 8:
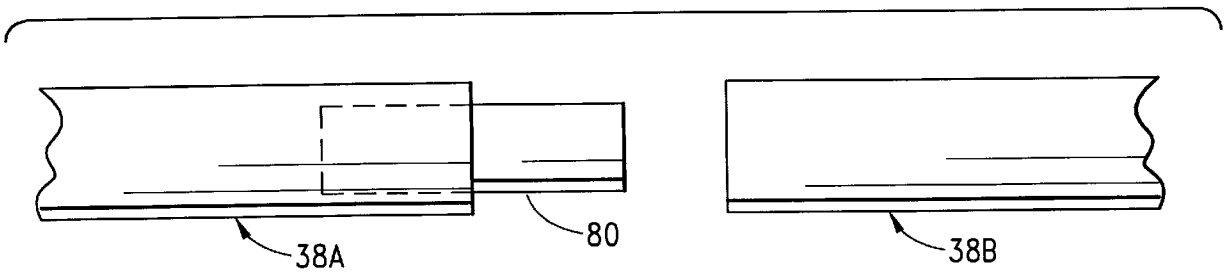
FIG. 8 is side elevational view of the mold assembly with the concrete laid over it. The concrete and the flexible cover are partially cut away.

With reference now to FIG. 8, once the mold assembly 60 is removed, the roadway 70 can be completed over the arch 66. Finishing the roadbed over an oval or elliptical bridge can be done by leveling the opposing ends with clays, gravels, waste rock, or the like, and then compacting the filler material 72. It can also be done using a material referred to as "flowable fill." Flowable fill is a low-grade concrete (100 to 150 pounds of cement per cubic yard) with high water content. It is self-leveling, versatile, inexpensive, and readily available. In addition, it reaches usable, but low compressive strengths of 125 to 150 pounds per square inch in 24 hours or less.

As described herein, one of the advantages of the present invention is that the components of the mold assembly are reusable from project to project. Some projects may require a concrete span having a width greater than the lengths of pipe. Of course, an inventory of various pipe lengths could be maintained. Alternately, the pipes 42 can be temporarily connected to form a longer pipe unit.

FIG. 9 illustrates how a pair of pipes 38A and 38B can be connected temporarily, end to end, to form a pipe unit of extended length. As shown, a connector 80 comprises a short tubular member having an outer diameter slightly smaller than the inner diameter of the pipes 38A and 38B. This allows the pipes 38A and 38B to be connected by simply inserting the connector 80 into adjacent ends of the pipes.

The diameter of the connector 80 should be selected to provide a tight, frictional engagement with the pipes 38A and 38B.

Figure 12:
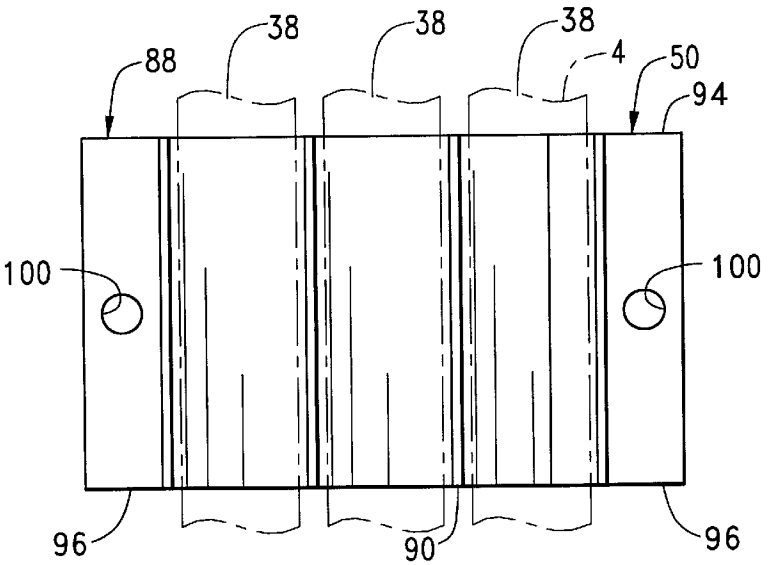
FIG. 12 is a plan view of the anchor assembly of FIG. 11.
Figure 10:
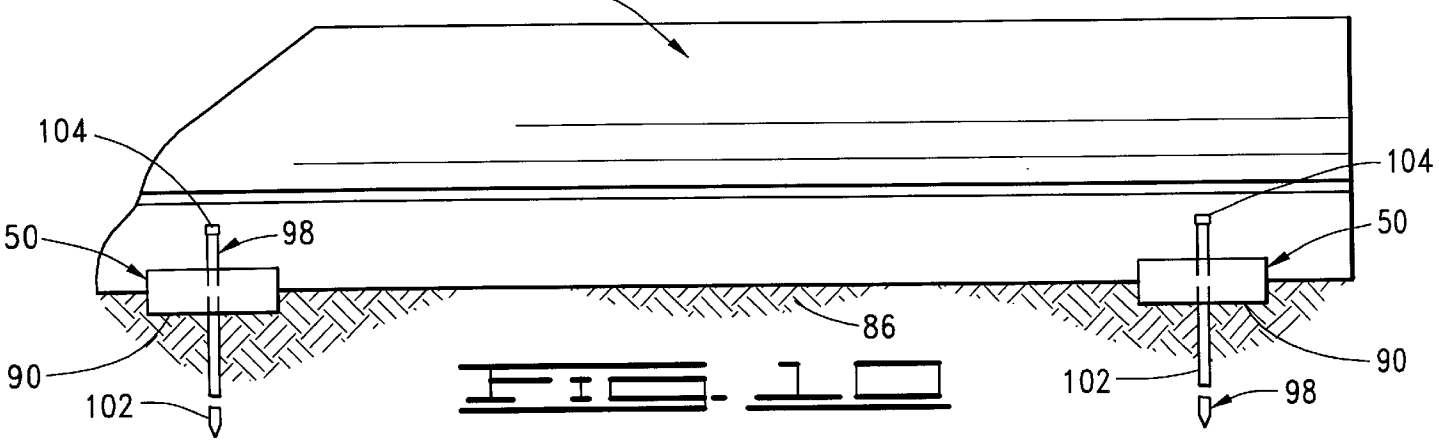
FIG. 10 is a side elevational view of a stack of pipes supported on a pair of spaced apart anchor assemblies.
Figure 11:
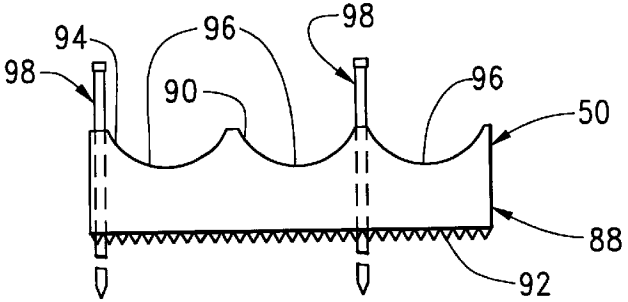
FIG. 11 is a side elevational view of one of the anchor assemblies shown in FIG. 10.

Attention now is directed to FIGS. 10–12 for a detailed description of a preferred anchor assembly 50 for use with the mold assembly 60. FIG. 10 shows a side view of several stacked pipes 38. A pair of anchor assemblies 50 supports the pipes 38 and anchors the mold assembly 60 to the underlying earth 86.

As shown best in FIGS. 11 and 12, the anchor assembly 50 in one embodiment comprises a tray assembly 88 comprising a tray 90. In its preferred from, the tray 90 is generally rectangular in shape having a bottom 92 and top 94. The bottom 92 preferably is generally flat but covered with "saw-tooth" grooves for a purpose to be described.

The top 94 of the tray 90 defines at least one and preferably a plurality of parallel channels 96. Each channel 96 is sized to receive a portion of a single pipe 38. While the tray 90 shown has three channels 96, the number of channels can vary widely.

In some cases, the tray assembly 88 is adapted to fix the pipes in it to the underlying earth. For that purpose, the tray 90 may be provided with at least one stake 98. The stake 98 is connectable to the tray 90. For example, in the present embodiment, the tray 90 is provided with a hole 100 sized to receive the stake 98. The stake 98 may comprise a shank 102 and an enlarged head 104. In this way, the hole 100 can be sized to receive the shank 102 up to the head 104.

In use, the tray assembly 88 may be used to position a row of pipes seated in the stream bed 14 as shown in FIG. 4, and keep the pipes from rolling outwardly. In this application, the tray 90 first is positioned where desired. Next, the free end of the shank 102 of the stake 98 is inserted through the hole 100. Then, the stake 98 is driven into the earth. The grooved bottom frictionally engages the underlying surface.

Figure 13:
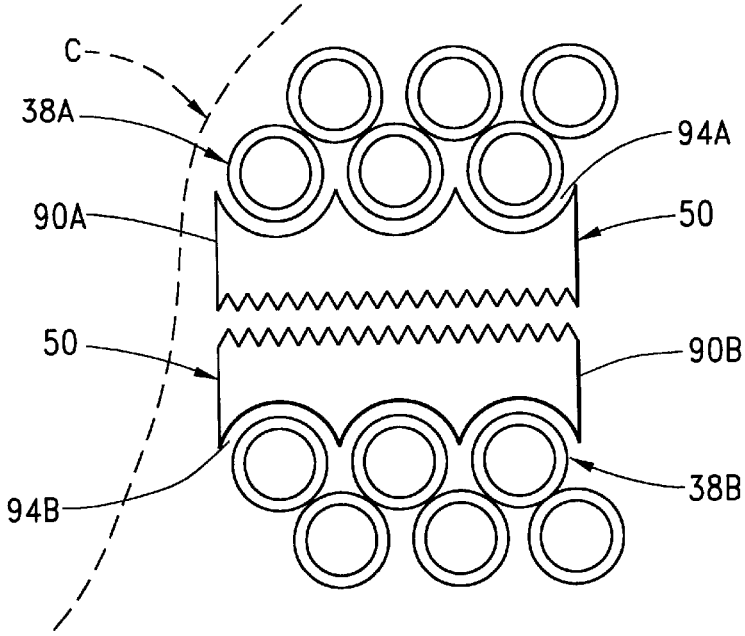
FIG. 13 illustrates the use of anchor trays to arrange the pipes.

With reference to FIG. 13, the use of multiple trays 90 will be described. As shown, two trays 90A and 90B are positioned bottom to bottom, with the top 94A of the upper tray 90*a* facing upwardly and the top 94B of the tray 90B facing downwardly. In this way, the grooved bottom surfaces engaging each other and lock the two trays in position relative to each other. The tray 90A holds the pipes 38A seated in it from rolling in either direction. In a similar manner, the upside-down tray 90B traps the pipes 38B under it and holds them in position as well.

As shown, the trays 90A and 90B are positioned so that they are aligned with each other. In this position, the trays allow one pipe to be positioned directly over another pipe, instead of nestled in the V-shaped space between two lower pipes, as would otherwise occur. Thus, using the trays 90A and 90B in this back-to-back fashion allows the incline of the upper contour of the completed stack 42, indicated in part by the line "C," to be controlled.

Figure 14:
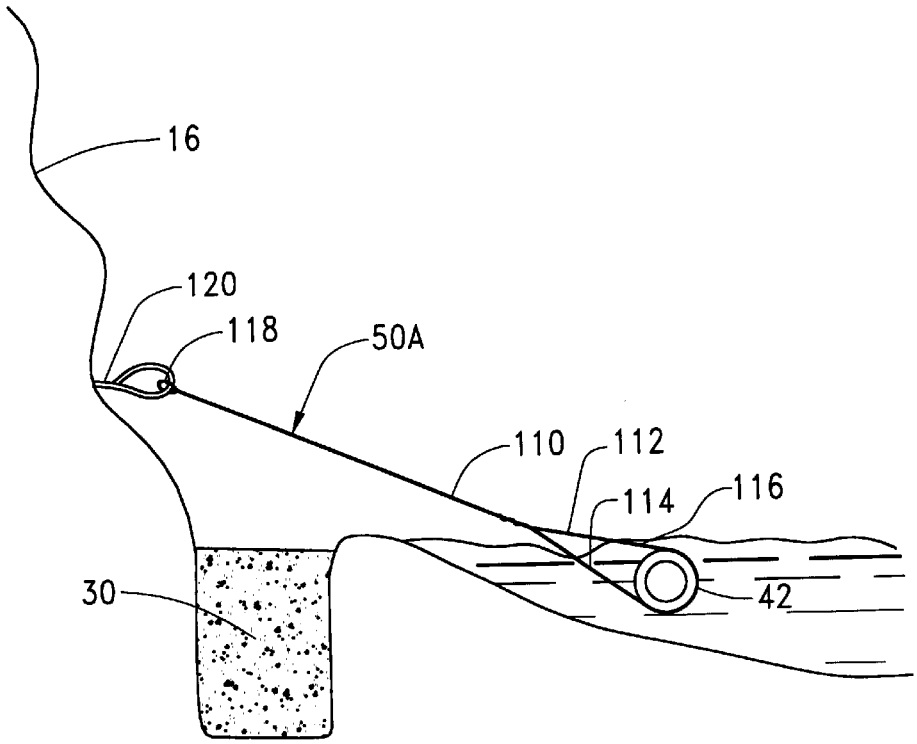
FIG. 14 shows a sling anchoring a pipe in position in a streambed.

With reference now to FIG. 14, another type of anchor assembly is illustrated. In this embodiment, the anchor assembly 50A comprises a sling 110 formed by a cable of some sort. The pipe end 112 of the sling 110 has two ends 114 and 116 that can be attached in some manner to the pipe 38. The other end 118 of the sling 110 is attachable to a stake 120 by means of an eyebolt, loop or other such device. The stake 120 is driven into the earth of the embankment 16 or other nearby structure. The anchor assembly 50A will prevent the attached pipe 38 from being dislodged by the flowing water 12 in the stream 10 (FIG. 3).

Now it will be appreciated that the method and apparatus of the present invention provide a simple and inexpensive molding technique for forming concrete into an arched shape for supporting bridges or other structures. Because the mold is formed on the site, no cranes or other heavy machines are necessary to move large pre-formed concrete structure, which substantially reduces the risk of personal injury and damage to the nearby landscape.

The construction method of the present invention allows the concrete to be formed in an oval shape so that the finished product becomes a curved structure in compression. In this way, inexpensive, moldable concrete can be used to a maximum engineering advantage.

Figure 15:
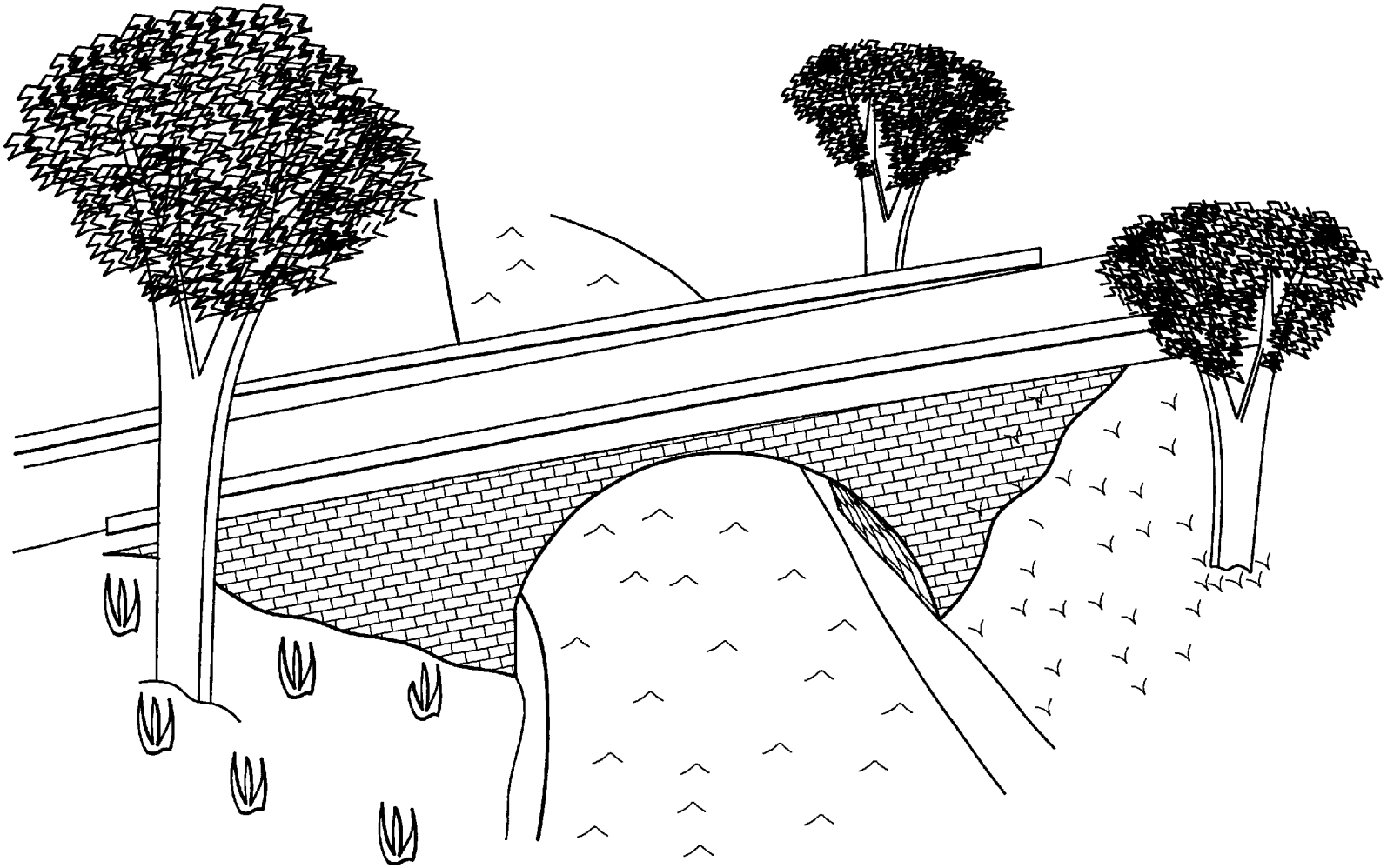
FIG. 15 is an illustration of a bridge supported on a veneered arch molded in accordance with the present invention.

Still further, the use of the multiple elongate elements to custom form the mold, allows virtually any configuration can be created. As best seen in FIG. 15, bridges built in accordance with the present invention, can accommodate nearby trees and uneven terrain, and can assume asymmetrical and irregular shapes. The structure can be designed with visible or exposed surfaces covered with brick, stone, or other decorative materials, to enhance appearance as well as durability.

The pipes and the anchor assemblies are collected at the completion of one project and can be reused in future projects indefinitely. All the materials and equipment are easy to use and readily available. Excavation for the footings requires only the use of an ordinary backhoe. Indeed, in some cases, the excavations could be dug out manually.

The PVC pipes are lightweight and can be arranged manually by one or two workers; no crane or other heavy machinery is necessary. Thus, only a few workers can complete the entire assembly and method, so that both labor and materials are relatively inexpensive. Yet, the end product has a high tension and compression strength, and will last longer.

Changes can be made in the combination and arrangement of the various parts and elements described herein without departing from the spirit and scope of the invention as defined in the following claims.

What is claimed is:

1. A mold assembly for molding a moldable composition, the mold assembly comprising:

a plurality of elongate elements stacked parallel to each other in multiple rows and in gravity-stable arrangement to form an upper contour of a selected shape, wherein the elongate elements are open-ended, rigid tubes and wherein the stacked elongate elements form a mold assembly adapted to mold the moldable composition in the selected shape of the upper contour.

2. The mold assembly of claim 1 wherein the elongate elements are circular in cross-section.

3. The mold assembly of claim 1 wherein the elongate elements are plastic.

4. The mold assembly of claim 1 further comprising particulate matter disposed between the elongate elements.

5. The mold assembly of claim 4 wherein the particulate matter comprises sand.

6. The mold assembly of claim 1 further comprising a leveling bed of particulate matter disposed between two rows of the elongate elements.

7. The mold assembly of claim 6 wherein the leveling bed comprises sand.

8. The mold assembly of claim 1 further comprising a cover sized to cover substantially the entire upper surface formed by the stacked elongate elements and wherein the cover is characterized as non-adherable to the moldable composition to be formed by the mold assembly.

9. The mold assembly of claim 1 further comprising an anchor assembly sized to receive at least one of the plurality of the stacked elongate elements.

10. The mold assembly of claim 9 wherein the anchor assembly comprises at least one tray having a top and a bottom, wherein the top defines a plurality of parallel channels, each channel sized to receive one of the elongate elements, and wherein the bottom is grooved.

11. The mold assembly of claim 9 wherein the mold assembly is adapted for use over the earth and wherein the anchor assembly further comprises at least one tray and at least one stake insertable through the tray into the earth to secure the tray removably to the earth.

12. The mold assembly of claim 9 comprising a sling having a first end attachable to at least one of the elongate elements and a second end connectable to the earth.

13. The mold assembly of claim 1 wherein the mold assembly is adapted for use over the earth, wherein the elongate elements are circular in cross-section, tubular and plastic, and wherein the assembly further comprises:

particulate matter between the stacked elongate elements;

an anchor assembly comprising a tray defining a channel sized to receive one of the elongate elements; and a flexible cover sized to cover substantially the entire upper surface formed by the stacked elongate elements, the cover being characterized as not permanently adherable to the moldable composition to be formed by the mold assembly.

14. The mold assembly of claim 1 wherein the mold assembly is adapted for use over the earth and wherein the assembly further comprises:

particulate matter between the stacked elongate elements;

an anchor assembly comprising a tray defining a plurality of parallel channels sized to receive the elongate members, and at least one stake insertable through the tray into the underlying earth to removable fix the position of the tray relative to the earth; and a flexible cover sized to cover substantially the entire upper surface formed by the stacked elongate elements and wherein the cover is characterized as not permanently adherable to material to be molded.

15. The mold assembly of claim 1 further comprising a leveling bed of particulate matter between two of the rows of the stacked, elongate elements and a flexible cover sized to cover substantially the entire upper surface formed by the stacked elongate elements and wherein the cover is characterized as not permanently adherable to moldable composition to be formed by the mold assembly.

16. The mold assembly of claim 1 wherein the mold assembly is adapted for use over the earth and wherein the mold assembly further comprises:

a leveling bed between two of the rows of the stacked, elongate elements; and and an anchor assembly comprising:

at least one tray defining a channel sized to receive one of the elongate members; and at least one stake insertable through the tray into the underlying earth to removably fix the position of the tray relative to the earth.

17. The mold assembly of claim 1 wherein the mold assembly is adapted for use over the earth and wherein the mold assembly further comprises:

a flexible cover sized to cover substantially the entire upper surface formed by the stacked elongate elements and wherein the cover is characterized as not permanently adherable to the moldable composition to be formed on the mold assembly; and an anchor assembly comprising:

at least one tray defining a plurality of parallel channels sized to receive the elongate elements; and at least one stake insertable through the tray into the underlying earth to removably fix the position of the tray relative to the earth.

18. The mold assembly of claim 1 further comprising a layer of veneer material positioned over the upper contour of the stacked elongate elements.

19. The mold assembly of claim 18 further comprising a flexible cover sized to cover substantially the entire upper surface formed by the stacked elongate elements and wherein the cover is characterized as not permanently adherable to the moldable composition to be formed on the mold assembly, and wherein the layer of veneer material is positioned over the flexible cover.

20. The mold assembly of claim 19 further comprising at least one anchor assembly adapted to secure at least one elongate element in position.

21. The mold assembly of claim 19 further comprising particulate matter disposed between at least some of the stacked elongate elements.

22. The mold assembly of claim 19 further comprising a pair of anchor assemblies, wherein each anchor assembly comprises a grooved bottom and a top defining at least one channel sized to receive one elongate element, and wherein the pair of anchor assemblies are positioned bottom-to-bottom so that the grooved bottoms engage each other.

23. The mold assembly of claim 1 further comprising a pair of anchor assemblies, wherein each anchor assembly comprises a tray with a grooved bottom and a top defining at least one channel sized to receive one elongate element, and wherein the pair of anchor assemblies are positioned bottom-to-bottom so that the grooved bottoms engage each other and so that elongate elements received in the channels of the trays are held in position relative to each other.

24. A method for molding a span of a moldable composition, comprising:

stacking a plurality of elongate elements parallel to each other in multiple rows and in gravity-stable arrangement to form an upper contour of a selected shape, wherein the elongate elements are open-ended, rigid tubes;

spreading unset moldable composition over the upper contour of the stacked elongate elements;

allowing the unset moldable composition to set; and removing the stacked elongate elements.

25. The method of claim 24 further comprising placing particulate matter between elongate elements on the stack.

26. The method of claim 25 wherein the step of removing the elongate elements commences with washing particulate matter from between the stacked elongate elements to loosen the stacked elements.

27. The method of claim 24 further comprising anchoring at least one of the elongate elements in a selected location.

28. The method of claim 27 wherein the elongate elements are stacked on the earth and wherein the step of anchoring is carried out by anchoring one of the elongate elements to the earth.

29. The method of claim 27 wherein the step of anchoring is carried out by anchoring an elongate element above others of the elongate elements.

30. The method of claim 27 further comprising, after stacking the elongate elements, covering the upper contour of the stacked elongate elements with a flexible cover to which the moldable composition will not adhere permanently.

31. The method of claim 30 further comprising anchoring at least one of the elongate elements in a selected location.

32. The method of claim 24 further comprising, after stacking the elongate elements and prior to spreading the unset moldable composition, covering the upper contour of the stacked elongate elements with a flexible cover to which the moldable composition will not adhere permanently.

33. The method of claim 24 further comprising depositing particulate matter in a layer to form a leveling bed between two rows of the elongate elements.

34. The method of claim 24 wherein, prior to spreading the unset moldable composition, a layer of veneer material is placed over at least a portion of the upper contour.

35. The method of claim 24 wherein the moldable composition is concrete.

36. The method of claim 35 further comprising, after stacking the elongate elements and prior to spreading the unset moldable composition, covering the upper contour of the stacked elongate elements with a flexible cover to which the moldable composition will not adhere permanently.

37. The method of claim 36 further comprising placing particulate matter between elongate elements on the stack.

38. The method of claim 37 wherein the step of removing the elongate elements commences with washing particulate matter from between the stacked elongate elements to loosen the stacked elements.

39. The method of claim 38 further comprising anchoring at least one of the elongate elements in a selected location.

40. The method of claim 39 wherein, prior to spreading the unset moldable composition, a layer of veneer material is placed over at least a portion of the upper contour.

* * * * *